US006083453A

United States Patent [19]

Diederich et al.

[11] Patent Number: 6,083,453

[45] Date of Patent: Jul. 4, 2000

[54] TUNDISH HAVING FUME COLLECTION PROVISIONS

[75] Inventors: David J. Diederich; John C. Paddock; George R. Petrilla, all of Avon Lake; Donald K. Mounsey, Amherst, all of Ohio

[73] Assignee: USS/KOBE Steel Company, Lorain, Ohio

[21] Appl. No.: 09/033,127

[22] Filed: Mar. 2, 1998

Related U.S. Application Data

[60] Provisional application No. 60/069,682, Dec. 12, 1997.

[51] Int. Cl.[7] ..... C21B 7/22

[52] U.S. Cl. ..... 266/158; 266/275

[58] Field of Search ..... 266/275, 45, 144, 266/158, 159; 222/590, 591, 594

[56] References Cited

U.S. PATENT DOCUMENTS

| | | | |
|---|---|---|---|
| 3,814,408 | 6/1974 | Cominotti . | |
| 4,012,029 | 3/1977 | Seguin et al. . | |
| 4,042,229 | 8/1977 | Eccleston . | |
| 4,050,367 | 9/1977 | Eakes . | |
| 4,076,224 | 2/1978 | Duchateau . | |
| 4,177,855 | 12/1979 | Duchateau et al. . | |
| 4,527,609 | 7/1985 | Nugent . | |
| 4,653,733 | 3/1987 | Bugajski et al. . | |
| 4,671,499 | 6/1987 | Ishiyama et al. . | |
| 4,724,895 | 2/1988 | Mulesa . | |
| 4,739,972 | 4/1988 | Podrini . | |
| 4,756,749 | 7/1988 | Praitoni et al. . | |
| 4,770,395 | 9/1988 | Vo Thanh et al. . | |
| 4,783,377 | 11/1988 | Kreth . | |
| 4,993,692 | 2/1991 | Brown et al. . | |
| 5,071,107 | 12/1991 | Schmidt et al. . | |
| 5,110,096 | 5/1992 | Zacharias | 266/275 |
| 5,169,591 | 12/1992 | Schmidt et al. . | |
| 5,219,514 | 6/1993 | Blostein et al. . | |
| 5,246,209 | 9/1993 | Heaslip et al. . | |
| 5,338,009 | 8/1994 | Pielet et al. . | |
| 5,348,275 | 9/1994 | Soofi . | |
| 5,397,105 | 3/1995 | Soofi . | |
| 5,494,266 | 2/1996 | Engelmann et al. . | |
| 5,551,672 | 9/1996 | Schmidt . | |
| 5,645,121 | 7/1997 | Barnes . | |
| 5,662,862 | 9/1997 | Braud et al. . | |

*Primary Examiner*—Scott Kastler

*Attorney, Agent, or Firm*—Fay, Sharpe, Fagan, Minnich & McKee, LLP

[57] ABSTRACT

Disclosed is a tundish assembly having fume collection provisions. The tundish assembly includes a tundish, a tundish cover, and a tundish hood. The hood has provisions for connecting the assembly to a vacuum source or other air moving means to thereby draw fumes or gases from the interior of the tundish out through the hood.

19 Claims, 5 Drawing Sheets

TUNDISH HAVING FUME COLLECTION PROVISIONS

CROSS-REFERENCE TO RELATED APPLICATION

The present application claims priority from U.S. provisional application Ser. No. 60/069,682, filed Dec. 12, 1997.

BACKGROUND OF THE INVENTION

1. Field of the Invention

The present invention relates to metallurgy and, particularly, the steelmaking arts. Specifically, the present invention provides a tundish, or reservoir vessel, having provisions for collecting hazardous fumes or gases.

2. Description of the Related Art

Tundishes are refractory-lined metal boxes conventionally used as a reservoir to control the flow of liquid metal between metal-working vessels, such as between a ladle and a continuous casting mold. In a typical tundish, metal flows into the vessel, fills it to a certain level, and exits through one or more bottom ports, often referred to as tundish nozzles. Typically, the sidewalls and bottom of a tundish are lined with at least one permanent refractory lining such as brick, and an inner expendable refractory lining which must be replaced periodically.

Refractory linings are known in the art such as described in U.S. Pat. No. 4,012,029 to Seguin et al. Seguin et al. describe a tundish having a refractory lining. The lining is disclosed as a cast monolithic lining. It is preferred to utilize a unitary refractory lining that is replaceable. Accordingly, artisans have directed efforts to such designs such as described in U.S. Pat. No. 4,993,692 to Brown et al. Brown et al. describe a tundish having a rigid outer case, an "inner expendable lining," and a flow control device (apparently integrally formed with the lining). The lining and flow control device are removable from the tundish.

It is also desirable to provide various flow control forms in the tundish or reservoir for manipulating the flow of the molten metal within and from the tundish. Accordingly, artisans have devoted efforts to the design of such flow control forms. U.S. Pat. No. 5,246,209 to Heaslip et al., pertains to a tundish having a flow control wall. FIGS. 2 and 5 of that patent illustrate in greater detail that flow control wall.

Efforts have also been directed toward providing sealed tundishes. U.S. Pat. No. 5,645,121 to Barnes is directed to a sealed tundish. The sealing means is described as a collection of planar rectangular boards arranged in abutting side-by-side relation along the top of the tundish. The boards are formed from a refractory ceramic fiber material. The ceramic fiber boards are used to help retain a blanket of argon gas introduced within the tundish, typically during a preheat operation. These moderately heat resistant ceramic fiber boards are prone to burn up or otherwise degrade upon the tundish reaching its maximum temperature. The boards are not provided to form a sealed tundish having fume collection provisions. Although the use of such planar members might reduce the level of hazardous fumes otherwise emitted from the tundish, there remains a need for significantly improved fume collection from a tundish.

In particular, there is a need for a tundish utilizing a replaceable unitary refractory lining in combination with provisions for improved fume collection from the tundish. It would also be particularly desirable to incorporate flow control provisions within the interior of the tundish, and especially in combination with a replaceable unitary refractory lining and/or improved fume collection provisions.

SUMMARY OF THE INVENTION

The present invention provides all of the foregoing objectives, and provides in a first aspect, a tundish assembly comprising a tundish container adapted to receive high temperature molten metal and having an open face, and a cover and hood assembly positioned over the open face and which is in communication with a vacuum source.

In another aspect, the present invention provides a tundish assembly comprising a tundish, an enclosure adapted for receiving a flow of molten metal, the enclosure disposed within the tundish, a tundish cover on the tundish, and a tundish hood in communication with the interior of the tundish.

In yet another aspect, the present invention provides a tundish assembly having fume collection provisions. The assembly comprises a first enclosure adapted for receiving and containing molten steel, the enclosure having an interior region and an open face providing access to the interior region. The first enclosure also includes a bottom wall having at least two discharge ports. The tundish assembly further comprises a second enclosure that is removable from, but typically disposed in, the first enclosure. The second enclosure is also adapted to receive high temperature molten steel. The second enclosure includes a plurality of flow apertures within one or more of its sidewalls for enabling molten steel to flow between the interior of the second enclosure and the interior of the first enclosure. The tundish assembly also comprises a cover positioned on the first enclosure and a hood in communication with the interior of the first enclosure.

DESCRIPTION OF THE PREFERRED EMBODIMENTS

Figure 1:
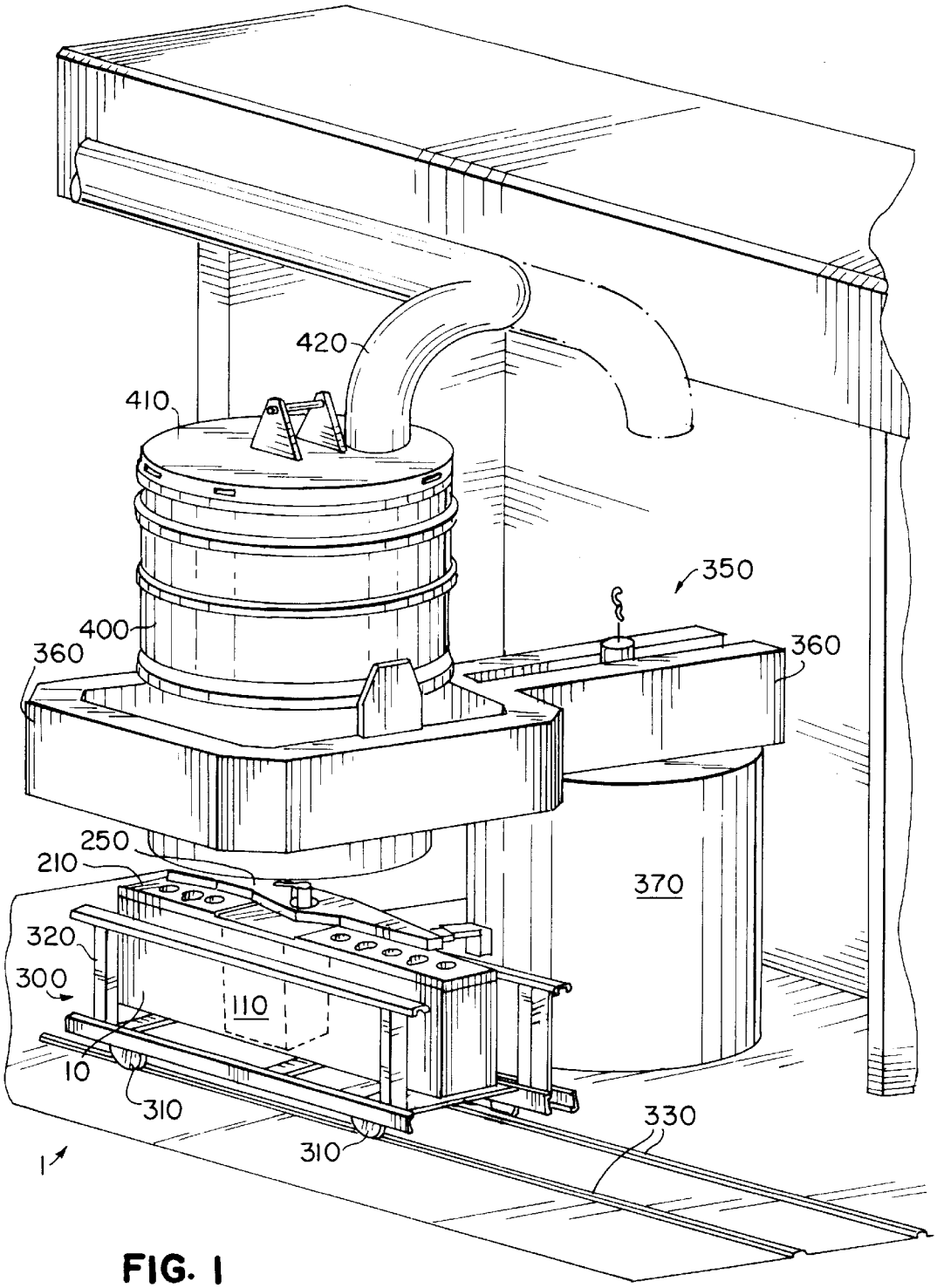
FIG. 1 illustrates a typical casting station in a process for manufacturing steel.

FIG. 1 illustrates a preferred embodiment tundish assembly 1 in accordance with the present invention. The tundish assembly 1 is particularly adapted to capture and collect hazardous agents emitted within its interior and around its upper exterior. The term "hazardous agents" as used herein includes agents, components, and particles of materials or components that are hazardous or potentially hazardous to human health, or which are considered to be pollutants or contaminants and which may be carried, entrained, or otherwise transported by a moving airflow or gas flow. FIG. 1 illustrates the tundish assembly 1 positioned under a ladle 400 such as prior to or during casting in a steel manufacturing operation. In this operation, molten steel contained within the ladle 400 is discharged into the tundish assembly 1. The ladle 400 is supported and retained by a turret 350 comprising an arm 360 and a turret base 370. As illustrated in FIG. 1, the ladle 400 is preferably covered by a cover 410 to which is connected a fume hood 420.

The tundish assembly 1 comprises a tundish 10, a bathtub 110, a tundish cover 210, and a tundish hood 250. Each of these components is described in greater detail below. The tundish assembly 1 is generally supported by a tundish car 300. The car 300 includes a support frame 320 and a plurality of wheels 310 which enable the car 300 to roll along one or more tracks 330.

During casting, such as shown in FIG. 1 in which the ladle 400 is held in a casting position by the turret 350, molten metal is transferred from the ladle 400 to the tundish 10. A single stream of molten metal flows from the ladle 400 through an inlet aperture described in greater detail below defined in the tundish cover 210 and the tundish hood 250 into the bathtub 110 residing within the tundish 10. The tundish distributes the molten metal contained within its interior into one or more streams of molten or partially solidifying, metal. These streams typically flow downward from the bottom of the tundish 10. The plurality of streams are typically directed to a bloom casting mold, as known in the art. After the contents of the tundish 10, i.e. the molten metal, have been emptied from the tundish, the tundish assembly 1 is typically moved to a tundish cooling area along the tracks 330. There, the tundish assembly 1 is allowed to remain for a period of time sufficient for the tundish 10 to cool to a suitable temperature. This operation is described in greater detail herein.

Figure 2:
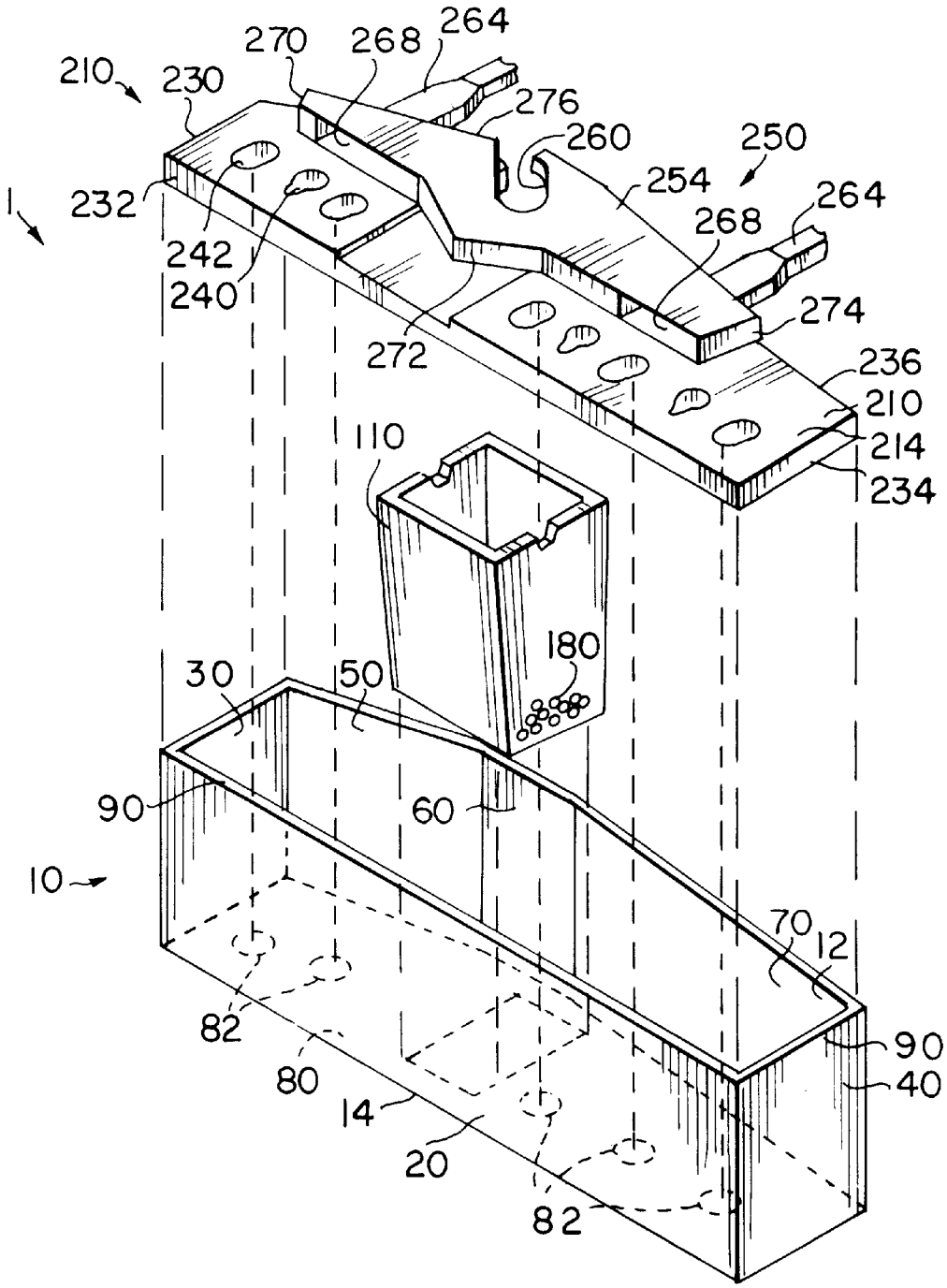
FIG. 2 is an exploded perspective view of a preferred embodiment tundish assembly in accordance with the present invention.

FIG. 2 illustrates in greater detail the preferred embodiment tundish assembly 1 in accordance with the present invention. The tundish assembly 1 comprises a tundish 10, a bathtub 110, a tundish cover 210, and a tundish hood 250. The tundish 10 includes a plurality of walls which generally form an enclosure having an interior chamber that is generally accessible through an upwardly directed open face. The tundish 10 comprises a first end wall 30 and an opposite second end wall 40. Spanning between the first end wall 30 and the second end wall 40 is a major wall 20. Oppositely disposed from the major wall 20 is a plurality of minor walls such as a first minor wall 50, a second minor wall 60, and a third minor wall 70. The first, second, and third minor walls, 50, 60, and 70, respectively, are in abutting side-by-side relationship to span between the first and second end walls 30 and 40. A bottom wall 80 extends between the bottom or lower edge of the walls 20, 30, 40, 50, 60, and 70. As shown in FIG. 2, the walls, 20, 30, 40, 50, 60, and 70 are arranged in abutting relationship to thereby define a continuous interior surface 12 and a continuous exterior surface 14. The tundish 10 also defines an upper plate or edge 90. The upper edge 90 generally circumscribes the open face of the tundish 10.

Referring further to FIG. 2, the tundish 10 is sized to receive and accommodate a bathtub 110. The term "bathtub" as used herein generally refers to a refractory or ceramic-based enclosure or container particularly adapted for holding molten metal such as steel. The bathtub 110 preferably defines a plurality of flow apertures 180 defined in one or more of its walls. It will be understood that one or more discharge openings 82 are typically provided in the bottom wall 80 of the tundish. Upon discharge of molten metal from the tundish 10, the molten metal flows through the discharge openings 82 in the tundish bottom wall 80, outward, such as towards the bloom casting area.

Referring further to FIG. 2, the tundish cover 210 is illustrated. The tundish cover 210 is generally planar in configuration having a plurality of heater openings 240 and stopper rod openings 242 defined along its upper surface. The tundish cover 210 is sized to generally fit over the upper edge 90 of the tundish 10 and generally cover the open face of tundish 10.

With further reference to FIG. 2, a tundish hood 250 is illustrated. The tundish hood 250 generally is disposed upon the cover 210 and provides provisions for connecting the hood 250 to one or more fume ducts 264. The tundish hood 250 has a plurality of inlet ports 268 and an inlet region 260, all of which are described in greater detail below for collecting fumes in and around the exterior of the tundish hood 250, the tundish cover 210 and the tundish 10.

Figure 3:
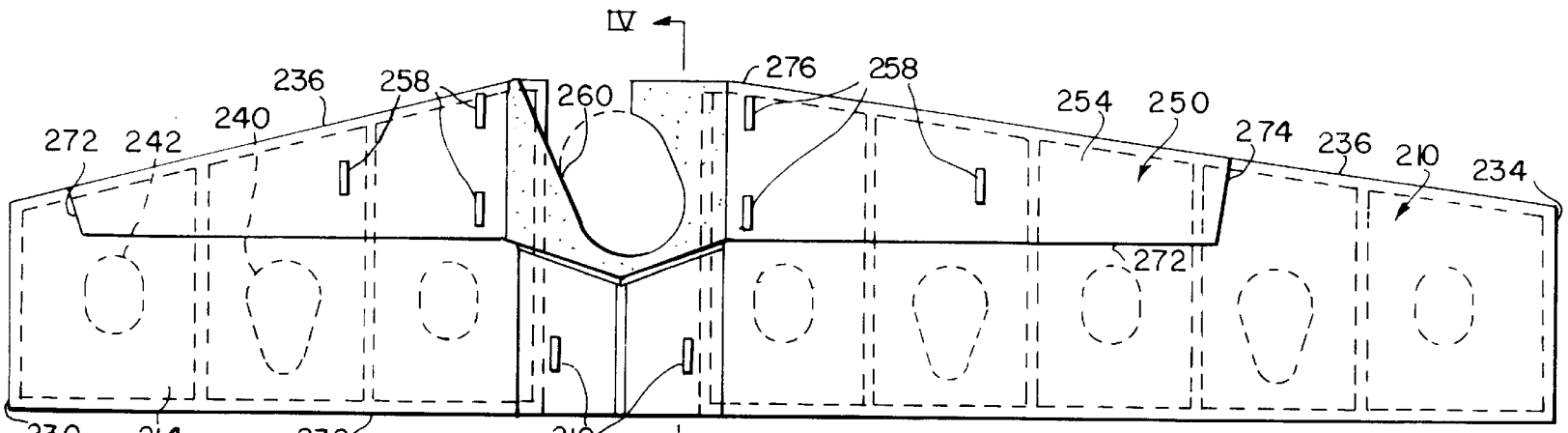
FIG. 3 is a plan view of a preferred embodiment tundish cover and a preferred embodiment tundish hood in accordance with the present invention.

FIG. 3 is a detailed plan view of the tundish cover 210 and the tundish hood 250. Referring to FIGS. 2 and 3, the tundish cover 210 comprises a top 214, a first end wall 230, an oppositely disposed second end wall 234, a first longitudinal side wall 232 extending between the end walls 230 and 234, and a second longitudinal side wall 236 also extending between the first and second end walls 230 and 234. The tundish cover 210 provides a plurality of openings through which the contents of the tundish 10 may be accessed. Preferably, a plurality of preheater openings 240 are provided along the top 214 of the cover 210. Similarly, a plurality of stopper rod openings 242 are also provided within the top 214. A tundish hood 250 is preferably disposed along the upper region of the cover 210. The tundish hood 250 may be disposed toward one side or region of the cover 210 such as proximate the second longitudinal sidewall 236 as shown. The tundish hood 250 comprises a top 254, a first end wall 270, a second end wall 274, a primary sidewall 272 extending between the first and second end walls 270 and 274, and a secondary sidewall 276 also extending between the first and second end walls 270 and 274. The tundish hood 250 further comprises a plurality of lifting lugs 258 extending upwardly from the top 254. The tundish hood 250 further provides an inlet region 260. The inlet region 260 enables the flow of molten steel from a ladle, such as ladle 400 illustrated in FIG. 1, to flow from the ladle through the tundish hood 250, tundish cover 210 and into the interior of the tundish 10. The tundish hood 250 further includes provisions for connection to one or more fume ducts 264 (as shown in FIG. 2). It is also preferred that the tundish hood 250 include one or more inlet ports or openings 268 defined around the periphery of the hood 250. The inlet ports 268 serve to draw fumes or hazardous gases residing along the tundish hood 250 and/or the tundish cover 210 into the fume ducts 264.

Figure 4:
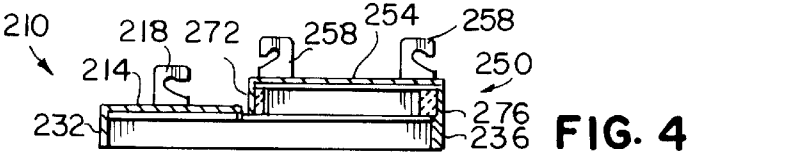
FIG. 4 is a cross-sectional view of the preferred embodiment tundish cover and hood illustrated in FIG. 3 and taken along line IV—IV.
Figure 5:
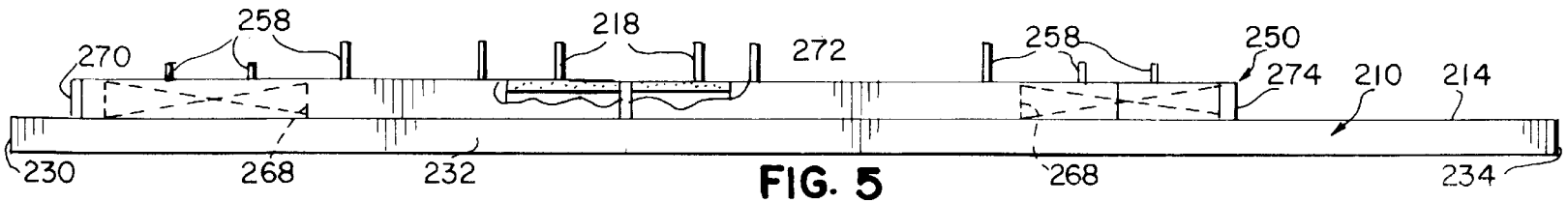
FIG. 5 is an elevational view of the preferred embodiment tundish cover and hood depicted in FIG. 3.
Figure 7:
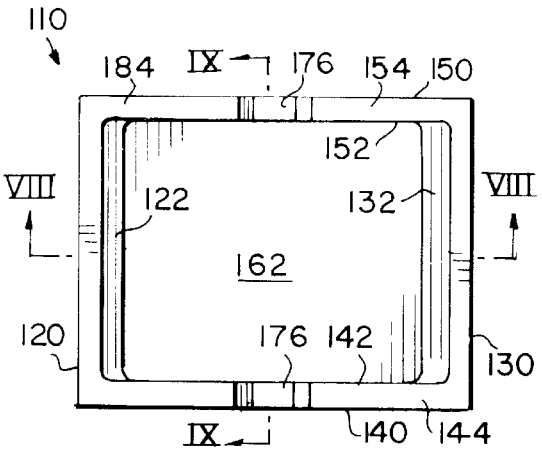
FIG. 7 is a plan view of the preferred embodiment bathtub illustrated in FIG. 6.

FIGS. 4 and 5 further illustrate the configuration of the tundish cover 210 and the tundish hood 250. FIG. 4 illustrates the tiered or stepped configuration preferably utilized for the hood 250 disposed upon the cover 210. Moreover, it can be seen that the plurality of lifting lugs 258 extend upwardly from the top 254 of the tundish hood 250. Moreover, a plurality of lifting lugs 218 extending upwardly from the top 214 of the tundish cover 210 may be provided. FIG. 5 illustrates an elevational view of the tundish cover 210 and the tundish hood 250 illustrated in FIG. 3. FIG. 5 illustrates a plurality of inlet ports 268 defined in the primary sidewall 272 of the tundish hood 250.

FIGS. 6 to 9 illustrate a preferred embodiment bathtub 110 in accordance with the present invention. The bathtub 110 preferably comprises a pair of opposing angled walls such as a first angled wall 120 and a second, opposite angled wall 130. The first angled wall 120 defines an interior face 122 and an exterior face 124. Similarly, the second angled wall defines an interior face 132 and an exterior face 134. The preferred embodiment bathtub 110 also includes a first transverse wall 140 having an interior face 142 and an exterior face 144. The wall 140 is referred to as transverse since it is generally perpendicular from a bottom wall 160 described in greater detail below. The bathtub 110 further comprises a second transverse wall 150, oppositely disposed from the first transverse wall 140. The second transverse wall 150 defines an interior face 152 and an exterior face 154. The previously noted bottom wall 160 defines an interior face 162 and an exterior face 164.

It is also preferred that the bathtub 110 comprises a particular configuration of notches defined along its upper periphery. Referring to FIGS. 6 to 9, the preferred embodiment bathtub 110 defines a notch 176 defined along one or both of the transverse walls 140 and/or 150. As shown in FIG. 2, the notches 176 serve to provide an airway or region above the bathtub 110 for the flow of gases through the upper interior region of a tundish assembly 1. This configuration promotes the collection of fumes from the interior of the tundish 10 toward the cover 210 and the hood 250 through the inlet region 260. The resulting configuration of walls 120, 130, 140, and 150 define a generally continuous rectangular top ledge 184.

Figure 6:
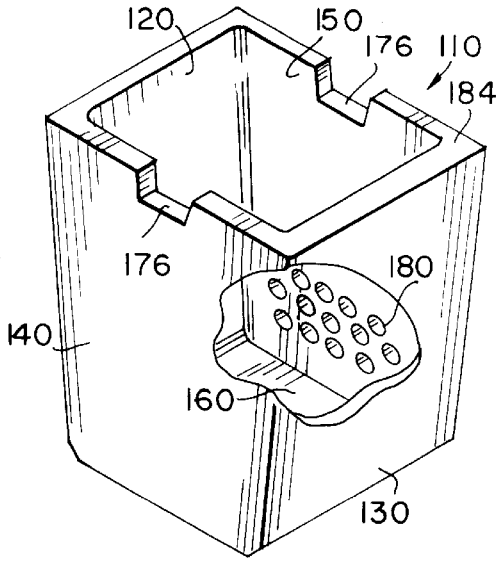
FIG. 6 is a perspective view and partial sectional view of a preferred embodiment bathtub utilized in the preferred embodiment tundish assembly.
Figure 8:
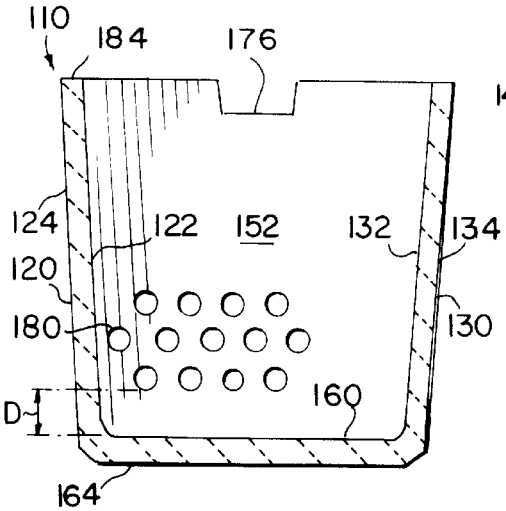
FIG. 8 is a cross-sectional view taken along line VIII—VIII in FIG. 7.
Figure 9:
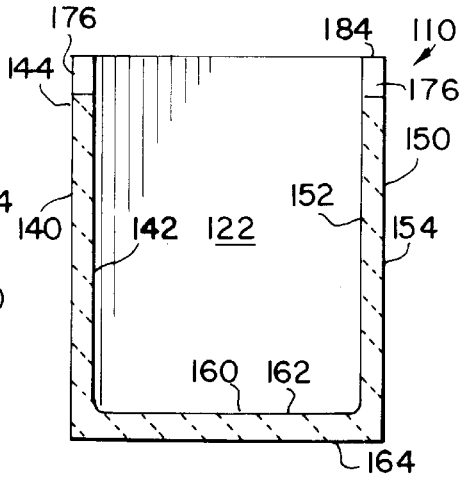
FIG. 9 is another cross-sectional view of the bathtub illustrated in FIG. 7 taken along line IX—IX.

As illustrated in FIGS. 2, 6, and 8, the bathtub 110 preferably defines a plurality of flow apertures 180 in the transverse walls 140 and 150. These flow apertures enable the lateral flow of molten steel or other material from and into the bathtub 110. The plurality of flow apertures 180 promote a common liquid level of molten steel to be attained throughout the tundish 10. The plurality of flow apertures 180, defined in the bathtub 110, enable molten steel or other material introduced into the bathtub 110 to flow laterally outward through the apertures 180 and exit the bathtub 110 and flow throughout the tundish 10. Then, a plurality of streams of molten steel or other material may be discharged from the tundish 10 through the discharge openings 82 defined in the tundish bottom wall 80. It is to be understood that although the preferred embodiment tundish assembly 1 has been described as providing five (5) streams of molten discharge, the present invention encompasses assemblies providing greater or fewer numbers of output streams. It may be preferred in some instances to utilize a particular arrangement of the bathtub 110 when positioned within the interior of the tundish 10, and the plurality of discharge openings 82. For example, a preferred arrangement is illustrated in FIG. 2 in which the bathtub 110 is disposed somewhat near the middle of the tundish 10 and between the discharge openings 82. This arrangement is advantageous since as molten material is introduced into the bathtub, it is directed laterally outward through the plurality of flow apertures 180, and generally over or above the discharge openings 82. Accordingly, in a most preferred embodiment, the bathtub 110, having a plurality of flow apertures 180 in two opposing sidewalls, is oriented within the tundish 10 such that each set of flow apertures is directed toward one or more discharge openings 82 in the bottom wall 80. This preferred orientation is depicted in FIG. 2.

The bathtub 110 preferably utilizes a configuration such that the lowermost flow apertures 180, i.e., those disposed nearest the bottom wall 160, are spaced from the interior face 162 of the bottom wall 160 a distance D, as shown in FIG. 8. This preferred configuration prevents the flow of lead that has precipitated, leached or otherwise separated from the molten steel mixture, or molten steel alloy containing a disproportionately large amount of lead, from exiting the bathtub 110 and tundish 10. This distance D may range from between about 1% to about 30% of the height of the bathtub 110.

Preferably, the bathtub 110 has a monolithic construction. The term "monolithic" as used herein refers to a form or configuration of the bathtub and its construction such that it is free from any joints or seams. Preferably, the bathtub 110 is formed from a refractory material capable of withstanding adverse effects of contact with high temperature molten metal. Moreover, the monolithic bathtub 110 preferably utilizes a homogenous composition throughout all regions. Accordingly, the composition of the bathtub at one location is the same, or substantially so, as the composition at a different location.

Figure 10:
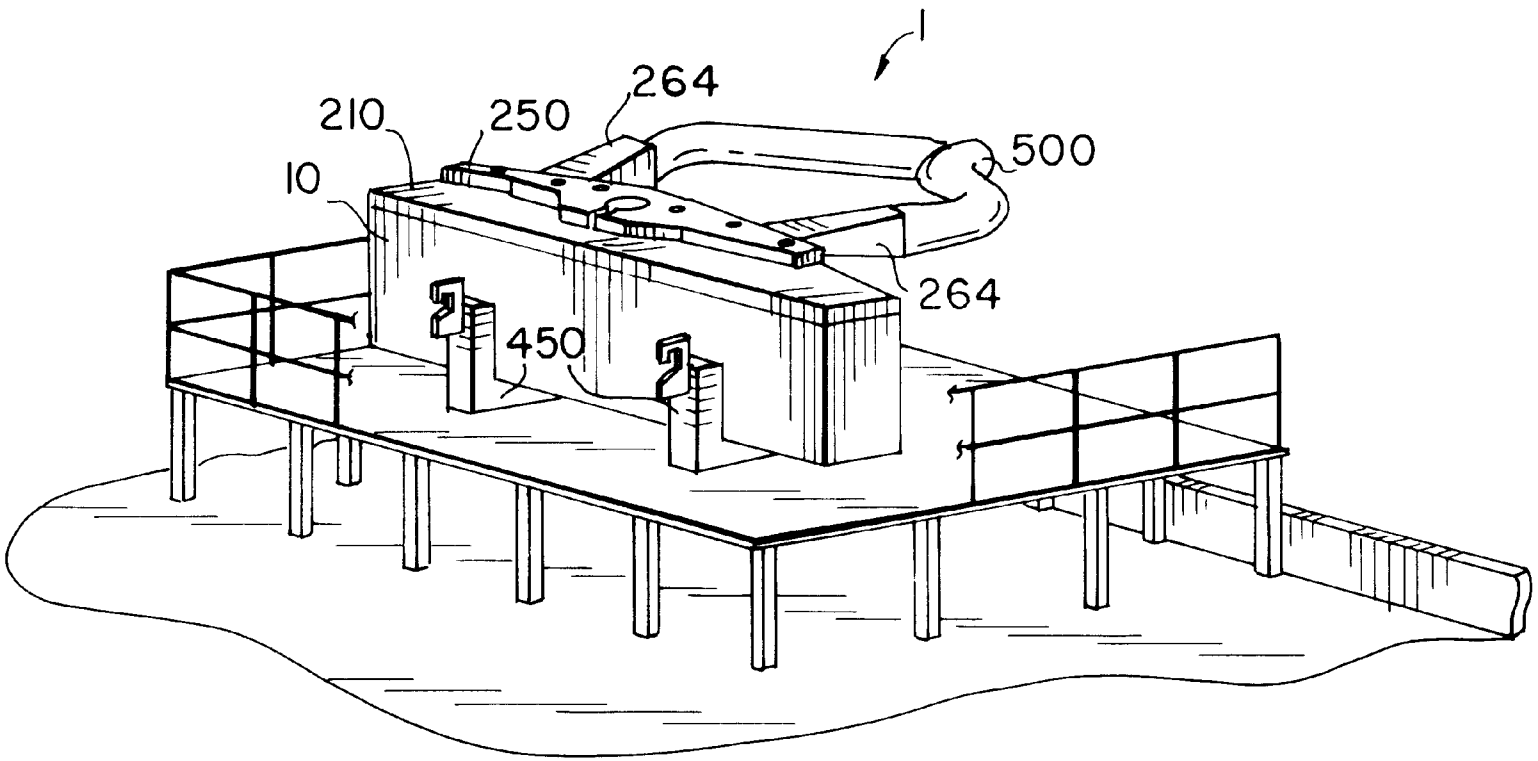
FIG. 10 is a view of a typical cooling station at which the preferred embodiment tundish assembly is placed and left to cool.

FIG. 10 illustrates a tundish assembly 1 comprising the tundish 10, the tundish cover 210, and the tundish hood 250 positioned at a tundish cooling station. The fume ducts 264 are preferably in communication with a vacuum source 500 for collecting and drawing fumes from the tundish assembly 1. The tundish assembly 1 is preferably disposed on a cooling station support assembly 450.

In a preferred application, fumes or gases containing hazardous agents are collected and removed from the tundish assembly 1 while the assembly is at a casting station, such as illustrated in FIG. 1. One or more fume ducts, similar to the fume ducts 264 shown in FIG. 2, are engaged with the hood 250 while the tundish assembly 1 is at the casting station. Upon completion of casting, the hood 250 may be disengaged from the one or more fume ducts at the casting station, and the tundish assembly 1 moved to the tundish cooling station, such as illustrated in FIG. 10. There, the fume ducts 264 are engaged with the hood 250.

At either the casting or cooling station, upon connecting the hood 250 to one or more fume ducts 264, as shown in FIG. 2, an air moving assembly is operated to create a pressure differential at the ducts 264 to thereby cause air to be drawn from the tundish hood 250 to the fume ducts 264. This results in air and other fumes to be drawn from the interior of the tundish 10 through the tundish hood 250 and to the fume hoods 264. As previously noted, air and fumes disposed along the exterior of the tundish assembly 1, particularly along the top 214, are also drawn into one or more inlet ports 268 defined around the periphery of the hood 250. Once collected in the hood 250, the air and fumes are directed to one or more fume ducts 264.

More specifically, the preferred fume collecting configuration is as follows. Referring to FIGS. 2, 3, 5, and 10, upon connection between the noted air moving assembly and the fume ducts 264, air and any hazardous agents within the interior of the tundish 10 are drawn from the tundish interior through the inlet region 260, and into the tundish hood 250. Once in the hood 250, the air and any hazardous agents are directed into the fume ducts 264 for subsequent exit from the tundish assembly 1. Any hazardous agents residing around or proximate to the upper exterior region of the tundish assembly 1, and specifically adjacent the tundish cover 210, are drawn into the hood 250 by the air moving assembly. That is, air and any hazardous agents proximate to the cover 210 are drawn into the hood 250 through the one or more inlet ports 268. Once in the hood 250, the collected air and agents are directed into the fume ducts 264 for subsequent exit from the tundish assembly 1. This fume collecting configuration results in a significant reduction in the emission of hazardous or potentially hazardous fumes from a tundish. Moreover, when taken in conjunction with the other unique aspects of the tundish 10 described herein, the tundish assembly 10 is expected to find wide application and great demand in industry.

The invention has been described with reference to the preferred embodiments. Obviously, modifications and alterations will occur to others upon a reading and understanding the preceding detailed description. It is intended that the invention be construed as including all such modifications and alterations in so far as they come within the scope of the appended claims or the equivalents thereof.

What is claimed is:

1. A tundish assembly comprising:

a tundish container defining an open face and adapted for containing high temperature molten metal, said container having an open face;

a cover and hood assembly disposed over entire said open face of said tundish container, wherein said cover and hood assembly is in communication with a vacuum source and fastened to said tundish container.

2. The tundish assembly of claim 1 further comprising:

at least one removable monolithic refractory-based bathtub disposed in said tundish container.

3. The tundish assembly of claim 2 wherein said bathtub comprises at least one sidewall projecting upward from a bottom wall, said sidewall defining at least one flow aperture, and said lowermost portion of at least one flow aperture being spaced a distance from said bottom wall.

4. The tundish assembly of claim 3 wherein said distance is from about 1% to about 30% of the height of said sidewall.

5. The tundish assembly of claim 1 wherein said cover and hood assembly define a plurality of inlet ports for collecting fumes along the exterior of said container.

6. A tundish assembly adapted for receiving and containing molten metal, said assembly comprising:

a tundish having an interior chamber generally accessible through an open face;

bathtub disposed in said interior chamber of said tundish, said bathtub having provisions for enabling the flow of said molten metal within said interior chamber of said tundish;

a tundish cover disposed on and fastened to said tundish and covering entire said open face; and a tundish hood in communication with said interior chamber of said tundish.

7. A tundish assembly of claim 6 wherein said bathtub has a monolithic construction.

8. The tundish assembly of claim 7 wherein said monolithic bathtub comprises a refractory material.

9. The tundish assembly of claim 7 wherein said bathtub includes a bottom wall and at least one sidewall.

10. The tundish assembly of claim 9 wherein said bathtub defines a plurality of apertures in at least one sidewall.

11. The tundish assembly of claim 10 wherein the lowermost portion of said plurality of apertures is spaced a distance from a bottom wall of said bathtub.

12. The tundish assembly of claim 11 wherein said distance is from about 1% to about 30% of the height of said sidewall.

13. A tundish assembly of claim 6 wherein said tundish hood includes a plurality of inlet ports defined along its periphery and adapted for drawing fumes into said tundish hood.

14. A tundish assembly having fume collection provisions, said tundish assembly comprising:

a first enclosure adapted for receiving and containing molten steel, said first enclosure having an interior region and an upwardly directed open face providing access to said interior region, said first enclosure including a bottom wall defining at least two discharge ports through said bottom wall;

a second enclosure disposed within and removable from said first enclosure, said second enclosure adapted for receiving high temperature molten steel, said second enclosure comprising a plurality of sidewalls projecting upward from a bottom wall to define an open top, at least one of said sidewalls defining a plurality of flow apertures enabling molten steel disposed within said second enclosure to flow out of said second enclosure and into said interior region of said first enclosure;

a cover disposed on and fastened to said first enclosure and covering entire said open face of said first enclosure a tundish hood in communication with said interior region of said first enclosure.

15. The tundish assembly of claim 14 wherein said tundish hood includes a plurality of inlet ports defined along its periphery and adapted for drawing fumes into said tundish hood.

16. The tundish assembly of claim 14 wherein said second enclosure is a monolithic refractory-based bathtub.

17. The tundish assembly of claim 14 wherein said second enclosure defines a first set of flow apertures defined in a first sidewall, and a second set of flow apertures defined in a second sidewall opposite from said first sidewall.

18. The tundish assembly of claim 17 wherein said second enclosure is disposed upon said bottom wall of said first enclosure and between said at least two discharge ports.

19. The tundish assembly of claim 18 wherein said second enclosure is oriented within said first enclosure such that said first set of flow apertures are directed toward a first discharge port defined in said bottom wall of said first enclosure and said second set of flow apertures are directed toward a second discharge port defined in said first enclosure.

* * * * *